US012209357B2

(12) United States Patent
Chang et al.

(10) Patent No.: US 12,209,357 B2
(45) Date of Patent: Jan. 28, 2025

(54) NON-WOVEN FILM FOR ELECTRONIC COMPONENTS AND FABRICATING METHOD THEREOF

(71) Applicant: TAIWAN TEXTILE RESEARCH INSTITUTE, New Taipei (TW)

(72) Inventors: Shao-Yen Chang, New Taipei (TW); Shang-Chih Chou, New Taipei (TW); Chun-Hung Lin, New Taipei (TW)

(73) Assignee: TAIWAN TEXTILE RESEARCH INSTITUTE, New Taipei (TW)

( * ) Notice: Subject to any disclaimer, the term of this patent is extended or adjusted under 35 U.S.C. 154(b) by 384 days.

(21) Appl. No.: 17/540,372

(22) Filed: Dec. 2, 2021

(65) Prior Publication Data

US 2022/0178071 A1 Jun. 9, 2022

(30) Foreign Application Priority Data

Dec. 7, 2020 (TW) ..... 109143050

(51) Int. Cl.

| | |
|---|---|
| ***D06M 11/79*** | (2006.01) |
| ***D06M 10/02*** | (2006.01) |
| ***D06M 10/06*** | (2006.01) |
| ***D06M 101/30*** | (2006.01) |

(52) U.S. Cl.

CPC ..... *D06M 11/79* (2013.01); *D06M 10/02* (2013.01); *D06M 10/06* (2013.01); *D06M 2101/30* (2013.01)

(58) Field of Classification Search

CPC ..... D06M 13/5135; D06M 2101/34; D06M 2101/30; D06M 2400/02; D06M 11/79; D06M 10/02; D06M 10/06

USPC ..... 442/59

See application file for complete search history.

(56) References Cited

U.S. PATENT DOCUMENTS

| | | | |
|---|---|---|---|
| 10,836,880 | B2 | 11/2020 | Yang et al. |
| 2009/0258180 | A1 | 10/2009 | Goulet |
| 2014/0255790 | A1 | 9/2014 | Matteucci et al. |
| 2017/0210093 | A1* | 7/2017 | Rikleen ..... B32B 27/304 |

FOREIGN PATENT DOCUMENTS

| | | | |
|---|---|---|---|
| CN | 103130231 | A | 6/2013 |
| CN | 104136512 | A | 11/2014 |
| CN | 107097492 | B | 3/2019 |
| CN | 110114390 | A | 8/2019 |
| CN | 110252152 | A | 9/2019 |

* cited by examiner

*Primary Examiner* — Camie S Thompson

(74) *Attorney, Agent, or Firm* — McClure, Qualey & Rodack, LLP

(57) ABSTRACT

A non-woven film for electronic components is provided in the present disclosure. The non-woven film for electronic components includes a polyetherimide substrate and an aerogel. The aerogel is disposed on the polyetherimide substrate. The aerogel has a moisture content between 0.7% and 0.9% and a porosity between 85% and 95%.

4 Claims, 3 Drawing Sheets

NON-WOVEN FILM FOR ELECTRONIC COMPONENTS AND FABRICATING METHOD THEREOF

RELATED APPLICATION

This application claims priority to Taiwan Application Serial Number 109143050, filed Dec. 7, 2020, which is herein incorporated by reference.

BACKGROUND

Field of Invention

The present disclosure relates to a non-woven film, and particularly relates to a non-woven film for electronic components.

Description of Related Art

Aerogels are unique solids with high porosity. The high porosity provide the aerogel with the characteristics of high specific surface area, low refractive index, low dielectric constant, low thermal loss coefficient, and low-frequency conductive medium. Therefore, aerogel has broad application prospects in the fields of integrated circuits, energy saving, and aviation.

In the conventional manufacturing method of aerogels, based on the characteristics of the reagents used, it is often necessary to additionally perform hydrophobic treatment on the aerogels. However, due to the fine structure of aerogels, it is often difficult to perform a comprehensive hydrophobic treatment thereon, and a lot of manpower and time are often required. Therefore, how to efficiently fabricate an aerogel with good hydrophobicity such that the aerogel can perform its electrical functions well is a problem that those skilled in the art desire to solve.

SUMMARY

The present disclosure provides a non-woven film material and a fabricating method of the non-woven film. The non-woven film of the present disclosure has a low dielectric constant value, a low dielectric loss value, and low hygroscopicity, such that the non-woven film is suitable for electronic components.

According to some embodiments of the present disclosure, a non-woven film for electronic components includes a polyetherimide substrate and an aerogel. The aerogel is disposed on the polyetherimide substrate and has a moisture content between 0.7% and 0.9% and a porosity between 85% and 95%.

In some embodiments of the present disclosure, the aerogel is manufactured by the following reagents including 92.5 to 97.5 parts by weight of a first alkyltrimethoxysilane and 2.5 to 7.5 parts by weight of a second alkyltrimethoxysilane or an aromatic trimethoxysilane.

In some embodiments of the present disclosure, the first alkyltrimethoxysilane is methyltrimethoxysilane, and the second alkyltrimethoxysilane is hexyltrimethoxysilane, octyltrimethoxysilane, or combinations thereof.

In some embodiments of the present disclosure, the aromatic trimethoxysilane is phenyltrimethoxysilane.

In some embodiments of the present disclosure, a particle size (D90) of the aerogel is between 100 nm and 200 nm.

According to some embodiments of the present disclosure, a fabricating method of a non-woven film, for electronic components, includes the following steps. Providing a polyetherimide substrate and an aerogel dispersion, in which the aerogel dispersion includes an aerogel, and the aerogel has a moisture content between 0.7% and 0.9% and a porosity between 85% and 95%. Dipping the polyetherimine substrate in the aerogel dispersion, such that the aerogel dispersion covers the polyetherimine substrate. Performing a thermal compression process on the polyetherimide substrate, such that the aerogel and the polyetherimide substrate are composited with each other. Performing an ultrasonic oscillating process on the polyetherimine substrate, such that the aerogel not being composited with the polyetherimine substrate is removed.

In some embodiments of the present disclosure, a preparing method of the aerogel dispersion includes the following steps. Uniformly mixing 92.5 to 97.5 parts by weight of a first alkyltrimethoxysilane and 2.5 to 7.5 parts by weight of a second alkyltrimethoxysilane or an aromatic trimethoxysilane, such that a mixture is formed. Performing a thermal reaction process on the mixture, such that a wet gel is formed. Performing a baking process on the wet gel, such that the aerogel is formed. Performing a dispersing process on the aerogel, such that the aerogel dispersion is formed.

In some embodiments of the present disclosure, the mixture includes a filler, and the filler includes methanol, ethanol, isopropanol, or combinations thereof.

In some embodiments of the present disclosure, the baking process includes a three-stage heating step, a temperature of a first heating step is between 45° C. and 55° C., a temperature of a second heating step is between 75° C. and 85° C., and a temperature of a third heating step is between 190° C. and 210° C.

In some embodiments of the present disclosure, a temperature of the thermal reaction process is between 60° C. and 80° C.

In the aforementioned embodiments of the present disclosure, since the aerogel fabricated by using the fabricating method of the present disclosure has appropriate moisture content and porosity, and can be firmly disposed on the polyetherimide substrate, the non-woven film can be provided with a low dielectric constant value, a low dielectric loss value, and low hygroscopicity. As such, the non-woven film is suitable for electronic components.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
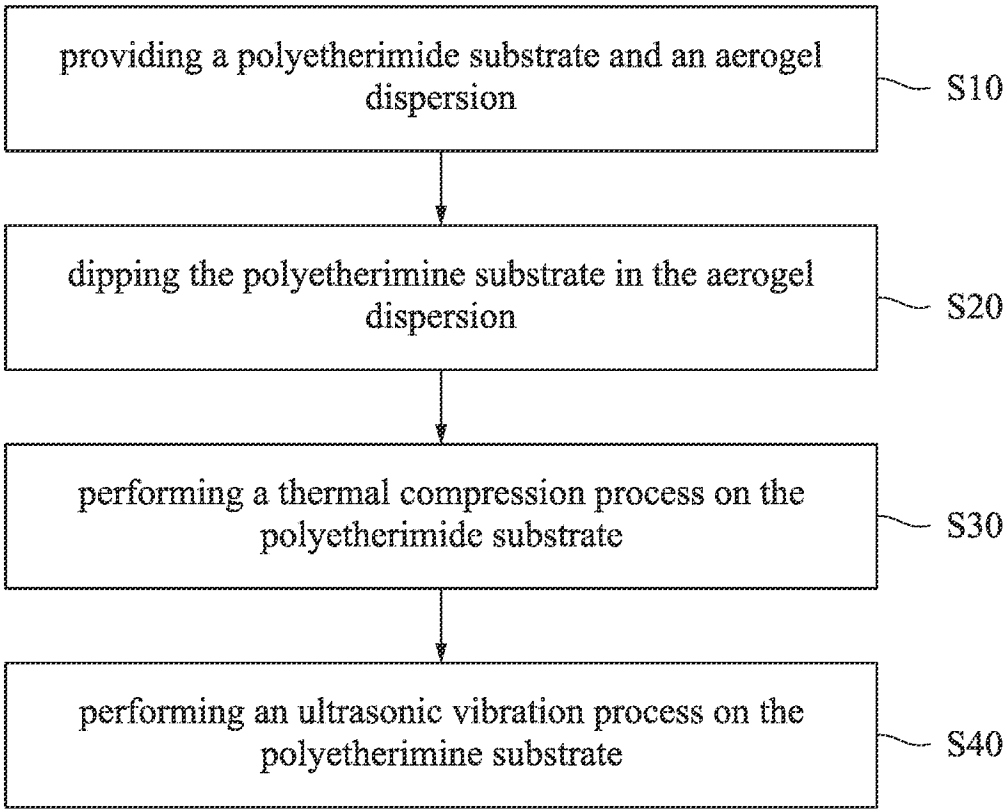
FIG. 1 is a flowchart illustrating a fabricating method of a non-woven film according to some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

The present disclosure provides a non-woven film and a fabricating method thereof. By firmly disposing an aerogel with appropriate moisture content and porosity on a polyetherimide substrate, the non-woven film can be provided with a low dielectric constant value, a low dielectric loss value, and low hygroscopicity, thereby being suitable for electronic components.

It should be understood that, for the sake of clarity and convenience of description, the fabricating method of the non-woven film will be described in advanced. FIG. 1 is a flowchart illustrating a fabricating method of a non-woven film according to some embodiments of the present disclosure. The fabricating method of the non-woven film material includes steps S10, S20, S30, and S40. In step S10, a polyetherimide substrate and an aerogel dispersion with an aerogel are provided. In step S20, the polyetherimide substrate is dipped in the aerogel dispersion. In step S30, a thermal compression process is performed on the polyetherimide substrate. In step S40, an ultrasonic oscillating process is performed on the polyetherimide substrate. In the following description, the above-mentioned steps will further be explained.

Firstly, step S10 is performed to provide a polyetherimide substrate and an aerogel dispersion with an aerogel. In some embodiments, the fabricating method of the aerogel dispersion may include sequentially forming a wet gel, the aerogel, and the aerogel dispersion. Hereinafter, the wet gel, aerogel, and aerogel dispersion and the fabricating method thereof will be described sequentially, so as to be a proof that this disclosure can be implemented.

<Wet Gel>

In some embodiments, a first alkyltrimethoxysilane and a second alkyltrimethoxysilane or an aromatic trimethoxysilane can be uniformly mixed to form a mixture, and the mixture is subjected to a thermal reaction process, so as to fabricate the wet gel of the present disclosure. In some embodiments, a usage amount of the first alkyltrimethoxysilane can be between 92.5 and 97.5 parts by weight, and a usage amount of the second alkyltrimethoxysilane or the aromatic trimethoxysilane can be between 2.5 and 7.5 parts by weight. In some embodiments, the first alkyltrimethoxysilane can be, for example, methyltrimethoxysilane; the second alkyltrimethoxysilane can be, for example, hexyltrimethoxysilane, octyltrimethoxysilane, or combinations thereof; the aromatic trimethoxysilane can be, for example, phenyl trimethoxysilane. In preferred embodiments, the second alkyltrimethoxysilane is hexyltrimethoxysilane, so as to subsequently form the aerogel with a small particle size. By directly using silane compounds with alkyl or aromatic groups to fabricate the wet gel, the wet gel can be provided with good hydrophobicity without the need of hydrophobic modification.

In some embodiments, the thermal reaction process may be a hydrolysis condensation cross-linking reaction, and the thermal reaction process may be carried out in a solvent. In some embodiments, the solvent may be methanol, ethanol, isopropanol, or combinations thereof, and a portion of the solvent may act as a filler, such that the aerogel formed subsequently is provided with high porosity. In some embodiments, a catalyst such as formic acid, acetic acid, hydrochloric acid, nitric acid, or sulfuric acid may be added to the mixture to accelerate the thermal reaction process. In some embodiments, a pH-value adjuster, such as ammonia, may be added to the mixture as appropriate to adjust the pH value of the mixture, thereby facilitating the progress of the thermal reaction process. In some embodiments, a temperature of the thermal reaction process may be, for example, between 60° C. and 80° C., and until the end of the reaction, a time of the thermal reaction process may be, for example, between 24 hours and 48 hours.

<Aerogel>

In some embodiments, the wet gel obtained from the above-mentioned method may be subjected to a baking process so to be dried to form into the aerogel. In some embodiments, the baking process may include a three-stage heating step. More specifically, the wet gel can be placed in an oven to be sequentially performed under the three-stage heating step, in which a temperature of a first heating step is between 45° C. and 55° C., and a time of the first heating step is between 13 hours and 15 hours; a temperature of a second heating step is between 75° C. and 85° C., and a time of the second heating step is between 1.5 hours and 2.5 hours; a temperature of a third heating step is between 190° C. and 210° C., and a time of the third heating step is between 1.5 hours and 2.5 hours. By utilizing the three-stage heating step for the baking process, the aerogel can be prevented from collapsing during the baking process, thereby forming the aerogel with high porosity and low density.

<Aerogel Dispersion>

In some embodiments, the aerogel obtained from the above-mentioned method may be subjected to a dispersion process, such that the aerogel is uniformly dispersed in the solvent to form the aerogel dispersion. Specifically, the solvent may be, for example, methanol, ethanol, or combinations thereof. In some embodiments, the aerogel dispersion may be further subjected to an ultrasonic oscillating process lasting about 5 minutes to promote the uniform dispersion of the aerogel. In some embodiments, a viscosity of the aerogel dispersion may be between 0.5 cP and 2.5 cP, so as to facilitate the dipping process of the polyetherimide substrate, which will be described in more detail below.

Next, step S20 is proceeded to dip the polyetherimine substrate in the aerogel dispersion, such that the aerogel dispersion covers the polyetherimine substrate, in which the polyetherimine substrate can be, for example, a melt-blown fabric formed by performing a melt blowing process on polyetherimide. In detail, when the polyetherimide substrate is dipped in the aerogel dispersion, the aerogel in the aerogel dispersion can be attached to a surface of the polyetherimide substrate. As mentioned above, since the viscosity of the aerogel dispersion can be between 0.5 cP and 2.5 cP, the dipping process of the polyetherimide substrate can be facilitated. In detail, if the viscosity of the aerogel dispersion is less than 0.5 cP, it may be difficult for the aerogel dispersion to be attached to the surface of the polyetherimide substrate due to the high fluidity of the aerogel dispersion; if the viscosity of the gel dispersion is greater than 2.5 cP, the aerogel may be attached to a specific area of the surface of the polyetherimide substrate in an excessively dense manner.

Subsequently, step S30 is proceeded to perform a thermal compression process on the polyetherimide substrate to which the aerogel is attached, such that the aerogel and the polyetherimide substrate are mutually composited. In some embodiments, the thermal compression process may be a thermal compression process through a hot plate. In some embodiments, a temperature of the thermal compression process can be between 150° C. and 210° C., and a time of the thermal compression process can be between 30 seconds and 60 seconds, so as to ensure that the aerogel is firmly attached to the surface of the polyetherimide substrate to be tightly composited with the polyetherimide substrate. On the other hand, the thermal compression process can also increase the density of the polyetherimide substrate, thereby enhancing the strength and tenacity of the polyetherimide substrate.

Next, step S40 is proceeded to perform an ultrasonic oscillating process on the polyetherimide substrate, so as to remove the aerogel that is not composited with the polyetherimide substrate. In some embodiments, the ultrasonic oscillating process can last between 5 minutes and 10 minutes to ensure that the aerogel which is not composited with the polyetherimide substrate is completely removed, and to prevent damage to the adhesion of the aerogel composited with the polyetherimide substrate. After the ultrasonic oscillating process, the polyetherimide substrate to which the aerogel is attached can be further washed and dried, such that the non-woven film of the present disclosure is obtained.

Figure 2:
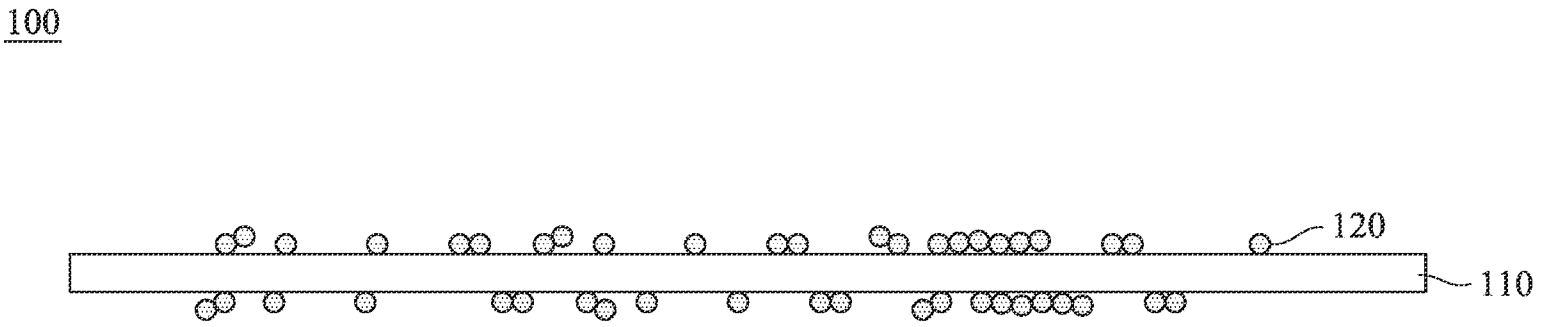
FIG. 2 is a schematic side view illustrating a non-woven film according to some embodiments of the present disclosure.
Figure 3:
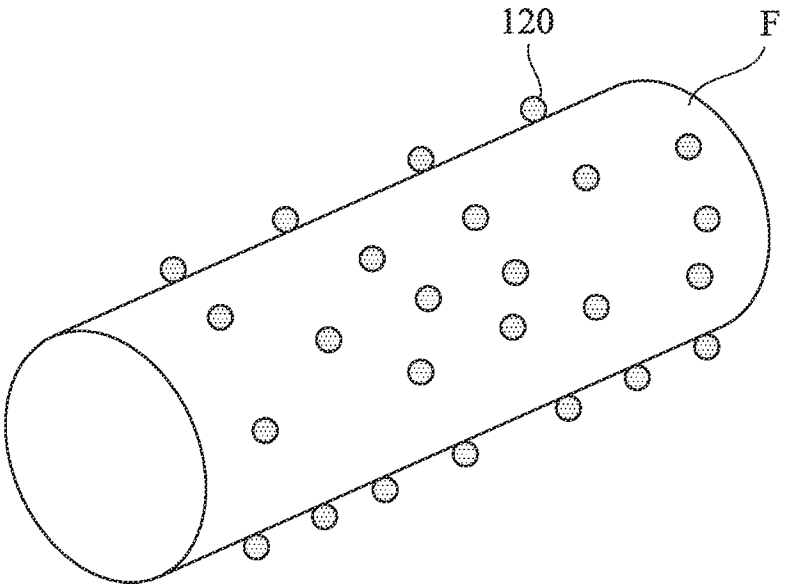
FIG. 3 is a schematic three-dimensional view illustrating a fiber of the non-woven film shown in FIG. 2.

As a whole, please refer to FIG. 2 and FIG. 3, in which FIG. 2 is a schematic side view illustrating a non-woven film 100 according to some embodiments of the present disclosure, and FIG. 3 is a schematic three-dimensional view illustrating a fiber F of the non-woven film 100 shown in FIG. 2. The non-woven film 100 of the present disclosure includes the polyetherimide substrate 110 and the aerogel 120. The aerogel 120 is disposed on the polyetherimide substrate 110. In some embodiments, the aerogel 120 may be disposed on two opposite surfaces of the polyetherimide substrate 110. If observed on a microscopic scale, the aerogel 120 can be disposed on the surface of each fiber F in the polyetherimide substrate 110 and does not exist inside the fiber F.

The aerogel 120 of the present disclosure has moisture content between 0.7% and 0.9% and porosity between 85% and 95%, so as to provide the non-woven film 110 with a low dielectric constant value, a low dielectric loss value, and low hygroscopicity for being applied to electronic components such as circuit boards. In detail, if the aerogel 120 has porosity less than 85% and/or moisture content greater than 0.9%, the aerogel 120 may not be used in electronic components due to its high dielectric constant value, high dielectric loss value, and high hygroscopicity. In some embodiments, the aerogel 120 may have a particle size (D90) between 100 nm and 200 nm, so as to prevent the whole non-woven film 100 from being provided with significant graininess, and to make the aerogel 120 uniformly disposed on the surface of the polyetherimide substrate 110. In detail, if the particle size (D90) of the aerogel 120 is greater than 200 nm, the non-woven film 100 may be provided with significant graininess, and the aerogel 120 is likely to be too dense on a specific area of the surface of the polyetherimide substrate 110.

In some embodiments, the non-woven film 100 may have a dielectric constant value between 1.30 and 1.35, a dielectric loss value between 0.0020 and 0.0022, and moisture content between 0.9% and 1.1%. Since the non-woven film 100 of the present disclosure has a low dielectric constant value, a low dielectric loss value, and low hygroscopicity (moisture content), the non-woven film 100 can be applied to electronic components with high frequency and short wavelength (e.g., a frequency between 10 GHz and 100 GHz and a wavelength between 0.001 m and 0.01 m). For example, the non-woven film 100 of the present disclosure can be applied to electronic components such as Bluetooth communications, servers, wireless networks, antennas, satellite systems, and advanced driver assistance systems (ADAS).

In the following descriptions, features and effects of the present disclosure will be described more specifically with reference to tests on the dielectric constant value, dielectric loss value, and moisture content of the non-woven films of an embodiment and some comparative examples. It is noted that without exceeding the scope of the present disclosure, the materials used, their amount and ratio, processing details, processing flow, etc. can be appropriately alternated. Therefore, the present disclosure should not be interpreted restrictively by the embodiments provided below.

The detailed description and test results for the non-woven films of the embodiment and comparative examples are shown in Table 1 below. The non-woven film of the embodiment is fabricated through the aforementioned steps S10 to S40. In addition, the dielectric constant value and dielectric loss value of the non-woven films of the embodiment and each comparative example are measured by ASTM D150 standard method, and the moisture content of the non-woven films of the embodiment and each comparative example is measured by CNS 13106 standard method.

TABLE 1

| | substrate | aerogel (usage amount) | dielectric constant value | dielectric loss value | moisture content of non-woven film |
|---|---|---|---|---|---|
| comparative example 1 | poly-etherimide substrate (melt-blown fabric) | N/A | 1.39 | 0.0025 | 1.27 |
| comparative example 2 | | JIOS aerogel (1 phr) | 1.42 | 0.0028 | N/A |
| comparative example 3 | | JIOS aerogel (20 phr) | 1.83 | 0.0034 | N/A |
| embodiment 1 | | aerogel of the present disclosure (1 phr) | 1.32 | 0.0021 | 1.00 |

Note 1:
JIOS is the abbreviation of the product name "JIOS AeroVa ® Aerogel Powder.
Note 2:
The unit "phr" refers to the number of grams of aerogel added into 100 grams of substrate.

It can be seen from Table 1 that, compared to the non-woven films fabricated without any aerogel or using commercially available aerogels, the non-woven film fabricated by using the aerogel of the present disclosure can indeed be provided with a low dielectric constant value, a low dielectric loss value, and low moisture content, so as to be better applied to electronic components.

In summary, since the aerogel fabricated by using the fabricating method of the present disclosure has appropriate moisture content and porosity, and can be firmly disposed on the polyetherimide substrate, the non-woven film can be provided with a low dielectric constant value, a low dielectric loss value, and low hygroscopicity, so as to be suitable for electronic components with high frequency and short wavelength.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A non-woven film for electronic components, comprising:

a polyetherimide substrate; and an aerogel disposed on the polyetherimide substrate and having a moisture content between 0.7% and 0.9% and a porosity between 85% and 95%, wherein a particle size (D90) of the aerogel is between 100 nm and 200 nm.

2. The non-woven film of claim 1, wherein the aerogel is manufactured by the following reagents, comprising:

92.5 to 97.5 parts by weight of a first alkyltrimethoxysilane; and 2.5 to 7.5 parts by weight of a second alkyltrimethoxysilane or an aromatic trimethoxysilane.

3. The non-woven film of claim 2, wherein the first alkyltrimethoxysilane comprises methyltrimethoxysilane, and the second alkyltrimethoxysilane comprises hexyltrimethoxysilane, octyltrimethoxysilane, or combinations thereof.

4. The non-woven film of claim 2, wherein the aromatic trimethoxysilane comprises phenyltrimethoxysilane.

* * * * *